United States Patent [19]

Hillenbrand et al.

[11] 4,329,626

[45] May 11, 1982

[54] PLASMA DISPLAY DEVICE

[75] Inventors: Bernhard Hillenbrand, Uttenreuth; Herbert Mai, Hallstadt; Karl Schuster, Marloffstein, all of Fed. Rep. of Germany

[73] Assignee: Siemens Aktiengesellschaft, Munich, Fed. Rep. of Germany

[21] Appl. No.: 164,570

[22] Filed: Jun. 30, 1980

[30] Foreign Application Priority Data

Jul. 19, 1979 [DE] Fed. Rep. of Germany ..... 2929270

[51] Int. Cl.[3] ..... H01J 61/28; H01J 61/12

[52] U.S. Cl. ..... 315/169.4; 313/178; 313/223; 313/218; 315/358

[58] Field of Search ..... 315/108, 169.4, 337, 315/358; 313/174, 178, 179, 188, 218, 223, 311

[56] References Cited

U.S. PATENT DOCUMENTS 3,622,829 11/1971 Watanabe ..... 315/169.4 X 3,942,161 3/1976 Byrum, Jr. et al. ..... 315/169.4 X 3,956,667 5/1976 Veith ..... 313/217 X

OTHER PUBLICATIONS

Welber, *Gas Display Panel,* IBM Technical Disclosure Bulletin, vol. 12, No. 10, Mar. 1970, pp. 1552–1553.

*Primary Examiner*—Eugene R. La Roche

*Attorney, Agent, or Firm*—Kenyon & Kenyon

[57] ABSTRACT

A plasma display device is provided with a gas discharge device which is filled with hydrogen as an ionizable gas and contains an aluminum cathode which is maintained continuously coated during the gas discharge with a film of an aluminum oxide which is either resistant to the hydrogen gas discharge, or the non-resistant portions of which are re-formed into the oxide by means of an additive. This plasma display device can be provided for flat picture screens, particularly of television sets, because during the required life of the gas discharge device, a premature rise of the operating voltage is prevented and, at the same time, there is little sputtering effect.

33 Claims, 3 Drawing Figures

PLASMA DISPLAY DEVICE

BACKGROUND OF THE INVENTION

This invention relates to plasma display device in general and more particularly to such a device with improved operating characteristics.

A plasma display device comprising a gastight housing, the interior of which contains a gas discharge space which is filled with an ionizable gas at a predetermined pressure and in which an electron and/or photon generating gas discharge is developed between at least one cathode of aluminum with, optionally, a small amount of other elements and at least one further electrode, as well as means for addressing the picture elements of a flat picture screen is disclosed in U.S. Pat. No. 3,956,667.

Display devices with a flat picture screen which can, for instance, replace the heretofore known color television tubes, frequently contain a planar electron source. The individual picture elements on the picture screen are then excited by electrons controlled by means of a matrix like addressing system. The electrons required therefore are in some cases produced directly in a gas discharge between a planar electrode and a further electrode. However, a photocathode following the gas discharge path can also serve as the electron source. In that case, electrons are released by photons which have been generated in the gas discharge. With such planar gas discharge cathodes, electrons with uniform density can be produced directly or indirectly. These electrons are relatively slow and their intensity can therefore easily be controlled.

Such a cathode of a display device with a flat picture screen is known, for instance, from U.S. Pat. No. 3,956,667 mentioned above. This device, in which a gas discharge is produced, contains auxiliary anodes for controlling the lines as well as the control electrodes for addressing the individual picture elements of a line which is turned on. In the interior of its gastight housing, which is under the predetermined pressure of a suitable filling gas such as argon or neon, a gas discharge path between a large area cathode and the auxiliary anodes, as well as an electron accelerating path between the control electrodes and an anode, are produced. A hole matrix formed by a plate of insulating material divides the common interior of the housing into a gas discharge space with a relatively great length for operation with low voltage for the gas discharge current, and a second space of short length and high field strength for accelerating the electrons. The auxiliary anodes associated with the lines of the matrix are arranged on the one flat side of the plate of insulating material serving as the hole matrix, and the control electrodes for addressing the picture elements are arranged on the opposite flat side. The electrons, which are generated in a glow discharge controlled line by line and which are moved toward the corresponding auxiliary electrode, are controlled point-by-point in the following electron accelerating section of high field strength by the correspondingly divided control electrode. There, they are accelerated toward the anode and are utilized on its picture screen for the excitation of defined picture elements. The anode is designed as a coherent, large area luminescent screen electrode. If a line of the auxiliary electrodes is addressed, the discharge burns uniformly along the entire line anode, while the so-called negative glow light of the gas discharge covers a region, the area of which is determined by the known dependence of the current density on the chosen cathode gas system and the gas pressure.

Instead of a single areal cathode, several subcathodes can also be provided for the known display device, to which a respective group of auxiliary anodes is assigned (U.S. Pat. No. 4,130,778).

In another known plasma display device, a glow discharge produced between two discharge electrodes is brought about for generating the electrons. Aluminum is provided as the material for the cathode (U.S. Pat. No. 3,622,829).

In a plasma display device, a high vacuum tight separation of the electron acceleration space from the gas discharge space may also be provided. To separate these two spaces, a light transparent partition is provided, having its side facing the picture screen provided with a photocathode as the electron source. The so-called negative glow light in the gas discharge space is then used for generate the photons which excite the photocathode to emit electrons (DE-OS No. 26 56 621).

A gas discharge suitable for these display devices must meet a number of requirements. One main requirement is to provide a suitable system of filling gas and electrodes in which, on the one hand, a gas discharge with sufficient electron yield is possible but, on the other hand, a system in which a breakdown in the electron post acceleration space, which is, for instance, at the same pressure as the gas discharge space, is prevented. In addition, an operating voltage which is as low as possible and is approximately constant should be required, since this simplifies the electrical controllability of the picture screen. In addition, it is necessary that little atomization of the cathode take place, i.e., that the sputter yield be low. Sputter yield is understood here to be the number of cathode atoms knocked out by positive ions by cathode sputtering, divided by the number of ions impinging on the cathode. For, a large amount of material removal at the cathode by sputtering can have an adverse effect on the electrical parameters of the gas discharge such as the operating voltage and the current density, for instance, through destruction of a surface layer advantageous for the gas discharge. In the case of electrically conductive deposits, furthermore, there is a danger of short circuits in the display device. On the other hand, electrically non-conducting sputter deposits on an anode or on auxiliary anodes can lead to a cutoff of the same.

It is therefore an object of the present invention to provide a display device of the type mentioned at the outset, in which these requirements are at least largely met. In particular, a system consisting of a gas discharge plasma and cathode is to be provided that leads to only a low sputter yield and in which the unavoidable sputter deposits are electrically non-conducting. In addition, the electrical parameters of the gas discharge should not change substantially during a required life of about 5,000 operating hours or more.

SUMMARY OF THE INVENTION

According to the present invention, this problem is solved by providing hydrogen as the ionizable gas and making provisions which insure that the cathode is always coated, during the gas discharge, with a thin film of an aluminum oxide. This is accomplished either by establishing a film which is resistant to the hydrogen gas discharge or by continuously reforming the non-resistant part of the film, on the cathode surface through oxidation by means of an additive in the gas discharge space.

An aluminum oxide film resistant to the hydrogen gas discharge is understood to mean a layer which is not sputtered off by the hydrogen plasma or only sputtered off to a small degree and which, in addition, does not enter into a chemical reaction with the plasma and, if applicable, with its impurities, or which reacts only to an extent which is negligible over the required life.

The use of hydrogen in the display device results in a number of advantages. Thus, a relatively high dielectric strength in an electron accelerating space, for instance, can be obtained with the hydrogen atmosphere which is provided. In addition, the current yield of the gas discharge, i.e., the current density at the cathode, is relatively large. Since, furthermore, hydrogen is a light gas with a low atomic weight, the gas particles ionized by the gas discharge can exert only a correspondingly small sputtering effect on the cathode surface.

Aluminum is basically advantageous as the cathode material with respect to sputter resistance because the oxide, with which its surface is always covered, has a high energy of sublimation and requires a relatively low operating voltages. In addition, aluminum oxide deposits with very high resistance are initially produced with aluminum cathodes. However, it has been found that, depending on the conditions of the preparation, the operating voltage of a gas discharge space with an aluminum cathode, filled with hydrogen, increases from an original value about 200 V to a value of more than 300 V after a few days. Some time after this increase, a conducting metallic sputter deposit is observed on the electrode serving as the anode for the gas discharge. It was discovered that a chemical change of the cathode surface, especially the generation of metallic aluminum which was formed on the originally oxide covered aluminum cathode, must be considered as the cause for this voltage rise. There are various reasons for this metal layer. Thus, for one, the original aluminum oxide layer can be used up at least on a portion of the cathode, for instance, at the rim, i.e., this part is removed by the ion bombardment of the gas discharge. In these places, metallic aluminum is then sputtered off, and is deposited on portions of the aluminum surface which may still be oxidized, resulting in an increase of the operating voltage at the same time. On the other hand, the danger that oxide still present will be converted superficially by the hydrogen plasma into pure metal or into aluminum hydroxide exists. Also reactions of the aluminum with gas impurities such as methane are possible. According to the present invention, these difficulties which arise when hydrogen is used, are circumvented by the fact that, during the gas discharge, the aluminum cathode is always maintained completely coated with an aluminum oxide layer which is resistant to the hydrogen gas discharge. In this manner, a metallic aluminum deposit can be avoided and a largely stable gas discharge can be obtained during the desired period of time.

In one implementation of the display device according to the present invention, a small amount of an aluminum oxidizing gas is advantageously present in the gas discharge space. This oxidizing gas can be formed, for instance, through reaction of the hydrogen with another added substance. Another possibility is to provide a body which, through its decomposition, provides a sufficient partial pressure of the oxidizing gas in the gas discharge space. This oxidizing gas then present in the filling gas can immediately oxidize metallic aluminum that may occur or re-form the oxide layer used up by sputtering. The undesirable instability of the electrical data of the gas discharge in the desired time period can thus, at least largely be suppressed.

It is furthermore advantageous to use a cathode which was subjected to a cathodic glow treatment in an oxygen atmosphere prior to the gas discharge in the hydrogen atmosphere. For, with the glow treatment, an oxygen supply can be incorporated into parts of the gas discharge path. This oxygen supply is then available in the subsequent gas discharge in the hydrogen atmosphere for the oxidation of the metallic aluminum or for the renewed formation of spent aluminum oxide. In addition, the oxide so formed is particularly sputter resistant. A further advantage of the oxygen glow treatment is the cleaning of the surfaces in the gas discharge space, which largely prevents, for instance, the undesirable formation of methane in the hydrogen gas discharge.

DETAILED DESCRIPTION OF THE INVENTION

For the design of a plasma display device with a flat picture screen in accordance with the present invention, the design of known display devices is taken as a starting point. The luminescent phosphors of the picture screen are to be excited by electrons, or also by photons, which are generated by means of a gas discharge. The device therefore contains a gas-tight housing which is filled with hydrogen at a predetermined pressure. Within the housing, the gas discharge is caused to occur between at least one large area cathode and further electrodes acting as an auxiliary anode. The planar cathode, which may also be subdivided, consists substantially of aluminum which may optionally contain small amounts of additional elements. In the gas discharge, provision is made, on the one hand, through the impingement of positive ions on the cathode, for replenishment of electrons which are necessary for maintaining the discharge. On the other hand, however, a problem arises in that cathode material is also knocked out in the process. This cathode material is deposited at other parts of the surface, for example, at other electrodes or at the inside walls of the housing and can cause short circuits between adjacent conductor runs or, in the case of non-conductive deposits, can block the passage of current. In addition, the cathode surface can also change through removal of its oxide layer, or through reaction with the hydrogen or its impurities, in the course of time and, as a result thereof, cause at least local changes of the operating voltage and the current density. The cathode sputtering as well as the change of the gas discharge characteristic has an adverse effect on the operability of the display device, especially its life. These difficulties and the manner in which the present invention overcomes them are explained further with the aid of the following examples.

EXAMPLE 1

Figure 1:
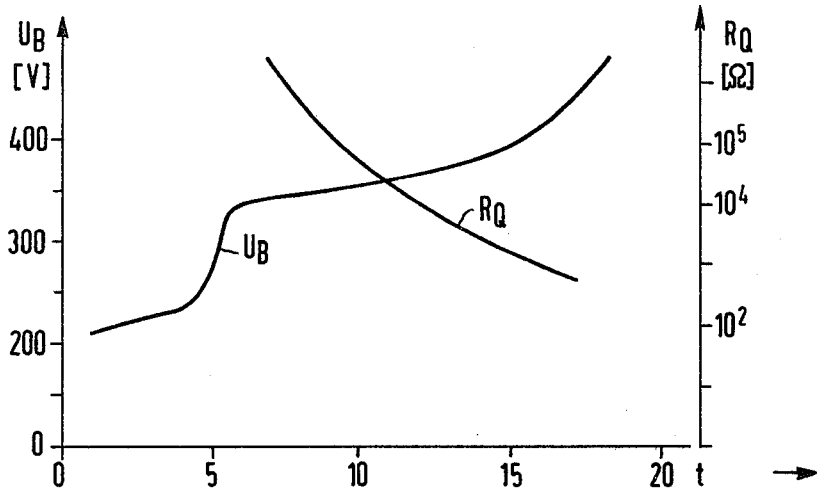
FIG. 1 is a diagram illustrating the change, over a period of time, of the operating voltage of gas discharge device with a conventional aluminum anode.

These difficulties, generally observed for hydrogen filled gas discharge devices where aluminum cathodes are used can be seen from the curves given in the diagram of FIG. 1. On one ordinate of this diagram the operating voltage $U_B$ in volts between two discharge electrodes of a gastight, hydrogen filled gas discharge path is plotted, and on the abscissa the burning time t of the gas discharge in days. Secondly, the shunt resistance $R_Q$ in ohms between the conductor runs of an anode subdivided into strips is noted on another ordinate. In the device, which the curve of the diagram represents, the gas discharge is to be operated without interruption at a hydrogen pressure of about 2 mbar. The cathode material is technical aluminum in accordance with DIN designation AL99/F11. This aluminum is coated with a thin natural oxide film a few nanometers thick. The cathode is etched and heated for 16 hours at 300° C. while the housing is being evacuated continuously. The anode contains parallel strip shaped conductor runs, each consisting of a nickel layer over a copper layer on a glass substrate. The strips are spaced about 50 μm from each other and are about 15 cm long. As can be seen from the curve of the diagram marked $U_B$, the operating voltage $U_B$ can be held at a value of about 200 V only for a limited time. After a few days, the operating voltage $U_B$ rises to a value of more than 300 V which, however, also is not stable but slowly increases further. The voltage rise can be explained by metallic aluminum that becomes formed on the aluminum cathode which was originally covered with the thin oxide layer. The increase of the operating voltage $U_B$ is accompanied by a decrease of the shunt resistance $R_Q$ between the electrically separated anode strips as can be seen from the shape of the curve marked $R_Q$. This decrease of the shunt resistance is caused by metallic aluminum which is deposited on the anode.

EXAMPLE 2

A similar curve is also observed if the natural oxide film on the aluminum cathodes has been further reinforced through anodic oxidation by wet chemistry means or in an oxygen discharge, since this oxide is reduced, at least partially, to metallic aluminum by the hydrogen plasma of the gas discharge.

In the plasma display device according to the present invention, provision is therefore made that the cathode is always coated with a thin film of an aluminum oxide during the gas discharge, so that the cathode surface, for all practical purposes, appears resistant to the hydrogen gas discharge. Possibilities to ensure such gas discharge resistant oxide layers are explained in the following examples.

According to these examples, an uninterpreted gas discharge is provided between the discharge electrodes. If such gas discharge devices are used in plasma display devices, however, each spot on the cathode only intermittently carries a load. Thus, an operating pause which generally is about 10 times as long as the operating time, occurs after a burning (operating) time of a few milliseconds. It was found then that the service life of the gas discharge device, i.e., the operating time prior to an undesirable rise of the operating voltage $U_B$, is accordingly about 10 times as long as the operating times determined when the gas discharge is operated continuously.

EXAMPLE 3

Figure 2:
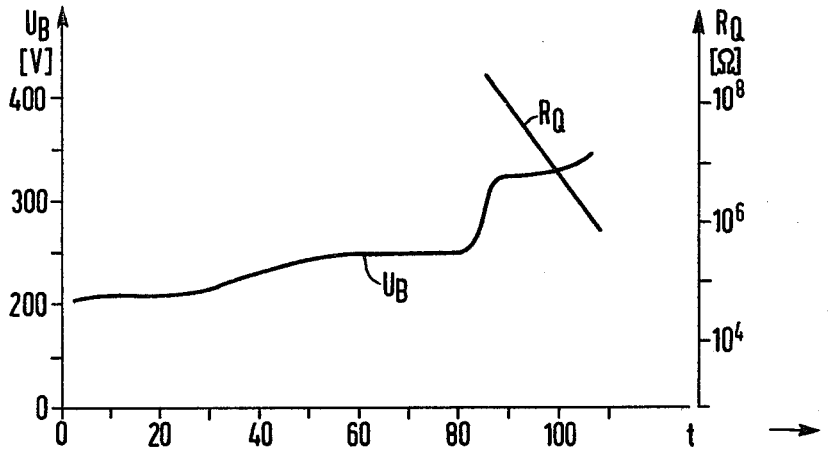
FIGS. 2 and 3 are corresponding diagrams for cathodes of plasma display devices according to the present invention.

The gas discharge device contains an anode of closely adjacent strip-shaped Ni-Cu layers according to the example on which the curves of the diagram in FIG. 1 is based. The cathode consists of high-purity aluminum (99.98%) and is etched as well as oxidized in air for 5 hours at 300° C., so that it is coated with a dense aluminum oxide film. A small amount (0.2 g) of gamma-$Al_2O_3$ is introduced into the gas discharge space. This substance can be used for drying an atmosphere and gives off, conversely, water at a very low partial $H_2O$ pressure. After evacuation, hydrogen is allowed to flow into the gas discharge space up to a pressure of 2.66 mbar, and subsequently, the gas discharge is fired. If through the gas discharge, the oxide film on the aluminum cathode is now reduced at, one point, to the extent that metallic aluminum could be sputtered off, new aluminum oxide is immediately formed again at this point by the oxidizing gas present in the hydrogen atmosphere, namely, the water. Through this addition of such a water-dispensing substance, the life of the gas discharge device can be increased considerably. In the diagram of FIG. 2, the coordinates $U_B$, $R_Q$ and t are the same as in the diagram according to FIG. 1; the curves of the operating voltage $U_B$ in time as well as of the shunt resistance at the anode of a corresponding gas discharge device are given by the lines marked with $U_B$ and $R_Q$, respectively. As can be seen from the $U_B$ curve of the diagram, a steep rise of the operating voltage $U_B$ takes place only after an uninterrupted operating time of the gas discharge of 84 days. After the voltage rise, a steep drop of the shunt resistance $R_Q$ between the closely adjacent parts of the anode is observed.

EXAMPLE 4

In a gas discharge device largely corresponding to Example 3, KOH is introduced into the gas discharge space as the water dispensing substance thereof instead of gamma-$Al_2O_3$. A life of more than 160 days of the aluminum cathode can be achieved thereby. The amount of the added KOH must be matched, like the gamma-$Al_2O_3$, to the gas discharge system.

EXAMPLE 5

Figure 3:
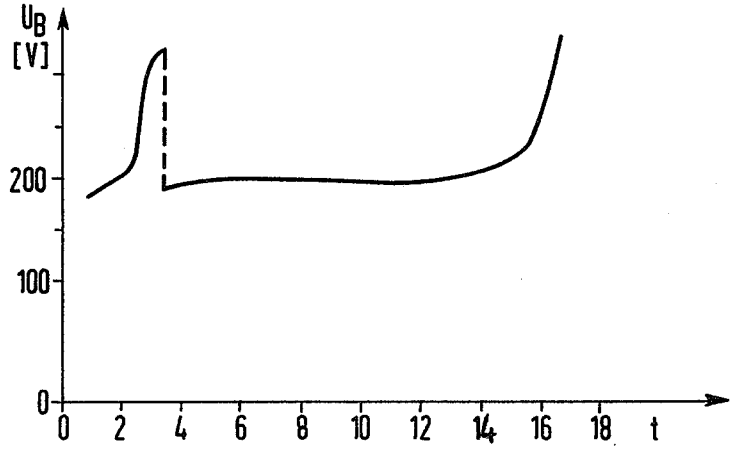

Instead of introducing an $H_2O$ dispensing substance into the gas discharge space of a gas discharge device according to Examples 3 and 4, predetermined amounts of oxidizing gases such as oxygen can be also added directly to the hydrogen atmosphere. The curve shown in the diagram of FIG. 3 is obtained for a gas discharged device with $O_2$ addition. The coordinates $U_B$ and t of the diagram are as in FIG. 2. It can be seen from the shape of the curve that in an $H_2$ gas discharge device, at an $H_2$ pressure of 2 mbar, the operating voltage $U_B$ already rises after about 2 days, when no separate, oxidizing gas is added to the $H_2$ atmosphere. According to this example, this voltage rise can be suppressed, however, for another 14 days by the addition of about 1% oxygen. Through the programmed addition of small amounts of oxygen from a supply tank, the operating voltage can therefore be stabilized at a lower voltage value for an extended period of time.

The supply tank for the oxygen can be, for instance, an ampoule, from which, through a suitable dosing valve, a predetermined amount of oxygen is transferred by manual intervention, such as by pressing a pushbutton or also automatically, when a predetermined value of the operating voltage is reached.

A body made of material of which holds bound oxygen, and gives off some oxygen through the application of a thermal pulse, can also be arranged in the gas discharge space. The thermal pulse, again, can be released automatically or manually when a given operating voltage threshold is reached. A suitable material for the body is, for instance, copper oxide, by which partial oxygen pressures higher than $10^{-8}$ mbar can be produced if it is heated to above 500° C.

Because of the great affinity of aluminum to oxygen, however, other oxygen containing gases, for instance, $CO_2$ or $H_2O$, can also be added, in a dosed manner, to the hydrogen atmosphere.

EXAMPLE 6

Instead of a dosed addition of oxygen to the hydrogen atmosphere of the gas discharge device according to Example 5, however, oxygen can also be liberated continuously from copper or copper oxide parts present in the gas discharge space with the cooperation of the hydrogen. These parts may be, for instance, current carrying parts of a display device. A sufficient quantity of oxygen can be dissolved in these parts advantageously by a preceding glow treatment in an oxygen atmosphere. An oxygen pressure between 0.5 and 5 mbar, for instance, 1 mbar, is practically provided here.

EXAMPLE 7

An operating voltage analogous to the curve in the diagram of FIG. 2 is also obtained for a gas discharge device with a nickel anode and a cathode of technical aluminum (AL99/F11) which is pressure jet lapped. The discharge section is baked out for 16 hours at 300° C. In addition, a cathodic glow treatment of the cathode is performed about 3 times for 10 minutes at room temperature in an oxygen atmosphere at a pressure of 1 mbar. The gas discharge space is evacuated between the individual glow treatment sections. During the glow treatment, the current density on the cathode is about 2 $mA/cm^2$, but this value is not critical. With such a pre-treatment, a sufficient oxygen supply, for one, can be incorporated into structural parts of the gas discharge path, and secondly, a particularly sputter resistant oxide layer can be generated on the cathode. The hydrogen pressure during the subsequent $H_2$ discharge is about 2.7 mbar. In this manner, a life of gas discharge devices of more than 110 days can be achieved.

EXAMPLE 8

Contrary to example 7 with a glow treatment of the aluminum cathode in an oxygen atmosphere at room temperature, the glow treatment can also be carried out at a temperature of about 300° C. If cathodes with such a glow treatment are used, a curve in an $U_B$-t diagram similar to FIG. 2 is obtained. The life of a gas discharge device prepared in this manner is at least 240 days.

While lowering the glow treatment temperature to about 150° C. leads to a shortening of the service life, the latter is still above the generally required life of 30 days.

EXAMPLE 9

Deviating from the pre-treatment of the gas discharge device according to example 8, the undesirable rise of the operating voltage during the required operating time can also be brought about by an anneal in an oxygen atmosphere without causing a glow discharge. By such an anneal at 300° C. for 10 minutes, repeated three times, for instance, a life of at least 110 days is obtained.

With the cathode of the plasma display device according to the present invention, good stability exists with respect to a variation of the operating conditions of its gas discharge device. Thus, doubling the hydrogen pressure does no harm. Advantageously, a pressure between 0.5 and 5 mbar and preferably between 1.5 and 3 mbar is provided. Furthermore, an operating point of the gas discharge can be chosen which is slightly in the anomalous region. In general, however, the operating conditions correspond to a glow discharge with normal cathode drop. Also the starting material of the aluminum cathode is not critical. Optionally, cathodes of technical aluminum alloys or electrolytic aluminum can also be used, especially if the latter are further subjected to a cathodic glow treatment in an oxygen atmosphere in accordance with examples 7 and 8. In addition, brushed Al surfaces may also be used instead of pressure jet lapped ones.

In examples 3 to 9, only one possibility of ensuring or developing an oxide layer resistant to the hydrogen discharge on the cathode is described in each case. In the plasma display device according to the present invention, several of these possibilities can also be provided simultaneously, of course.

What is claimed is:

1. In a plasma display device with a gastight housing, the interior of which contains a gas discharge space which is filled with an ionizable gas at a predetermined pressure and in which an electron and/or photon generating gas discharge is developed between at least one cathode of aluminum with, optionally, a small amount of other elements and at least one further electrode, said display device also including means for addressing the picture elements of a flat picture screen, the improvement comprising:

(a) hydrogen being provided as the ionizable gas;

(b) a cathode which is coated with a thin film of an aluminum oxide; and (c) means to maintain the cathode continuously coated with said thin film of an aluminum oxide during the gas discharge.

2. The improvement according to claim 1, wherein said means to maintain comprises a small amount of a gas which oxidizes aluminum present in the gas discharge space.

3. The improvement according to claim 2, and further including means to supply a dosed addition of the oxidizing gas to the hydrogen atmosphere.

4. The improvement according to claim 3, wherein said means to supply adds the oxidizing gas as a function of the operating voltage of the gas discharge.

5. The improvement according to claim 2 comprising a body, which dispenses one of an oxidizing gas and a gas component which reacts with hydrogen to form an oxidizing gas, disposed in the gas discharge space.

6. The improvement according to claim 5, wherein said body comprises an oxygen dispensing body, selected from the group consisting of copper and copper oxide, disposed in the gas discharge space.

7. The improvement according to claim 5, wherein said body is a body which has been pretreated by means of an anodic glow treatment in an oxygen atmosphere.

8. The improvement according to claim 7 and further including means to heat said body to cause it to give off oxygen into the gas discharge space.

9. The improvement according to claim 5, wherein said body is a water dispensing substance.

10. The improvement according to claim 9, wherein said substance is selected from the group consisting of KOH and gamma-$Al_2O_3$.

11. The improvement according to claim 1 wherein said cathode is an aluminum cathode which has been pretreated with a cathodic glow treatment in an oxygen atmosphere, before the gas discharge in the hydrogen atmosphere is fired, to create a highly sputter resistant film which acts as the means maintaining said cathode coated.

12. The improvement according to claim 1 wherein said hydrogen is at a pressure between 0.5 and 5 mbar.

13. The improvement according to claim 12, wherein said hydrogen pressure is between 1.5 and 3 mbar.

14. An improved method of operating plasma display device with a gastight housing, the interior of which contains a gas discharge space which is filled with an ionizable gas at a predetermined pressure and in which an electron and/or photon generating gas discharge is developed between at least one cathode of aluminum with, optionally, a small amount of other elements and at least one further electrode, said display device also including means for addressing the picture elements of a flat picture screen so as to increase its useful operating life, comprising:

(a) using hydrogen as the ionizable gas; and (b) maintaining the cathode continuously coated with a thin film of an aluminum oxide during the gas discharge.

15. The method according to claim 14 comprising maintaining a small amount of a gas which oxidizes aluminum in the gas discharge space.

16. The method according to claim 15 comprising supplying dosed additions of the oxidizing gas to the hydrogen atmosphere.

17. The method according to claim 16, comprising adding the oxidizing gas as a function of the operating voltage of the gas discharge.

18. The method according to claim 15 comprising disposing a body, which dispenses one of an oxidizing gas and a gas component which reacts with hydrogen to form an oxidizing gas, in the gas discharge space.

19. The method according to claim 18 wherein said body comprises an oxygen dispensing body, selected from the group consisting of copper and copper oxide, disposed in the gas discharge space.

20. The method according to claim 18 comprising pretreating said body by means of an anodic glow treatment in an oxygen atmosphere to cause it to absorb oxygen.

21. The method according to claim 19 and further including heating said body to cause it to give off oxygen into the gas discharge space.

22. The method according to claim 18 wherein said body is a water dispensing substance.

23. The method according to claim 22 wherein said substance is selected from the group consisting of KOH and gamma-$Al_2O_3$.

24. The method according to claim 14 comprising treating said cathode with a cathodic glow treatment in an oxygen atmosphere before the gas discharge in the hydrogen atmosphere is fired.

25. The method according to claim 24, comprising maintaining a pressure of the oxygen atmosphere between 0.5 and 5 mbar during said cathodic glow treatment.

26. The method according to claim 25, wherein said oxygen pressure is about 1 mbar.

27. The method according to claim 24 wherein said cathodic glow treatment is carried out at room temperature.

28. The method according to claim 24 said cathodic glow treatment is carried out at at least 150° C. and preferably, at least 250° C.

29. The method according to claim 28, wherein said cathodic glow treatment is carried out at about 300° C.

30. The method according to claim 14 comprising carrying out a glow treatment of the gas discharge space with the electrodes in places in an oxygen atmosphere before the gas discharge in the hydrogen atmosphere is fired.

31. The method according to claim 30, comprising carrying out repeated glow treatments of the gas discharge space at about 300° C.

32. The method according to claim 14 wherein said hydrogen is at a pressure between 0.5 and 5 mbar.

33. The method according to claim 32, wherein said hydrogen pressure is between 1.5 and 3 mbar.

* * * * *